United States Patent [19]

High

[11] Patent Number: 4,731,182

[45] Date of Patent: Mar. 15, 1988

[54] DECANTER CENTRIFUGE

[75] Inventor: Robert E. High, St. Ives, Australia

[73] Assignee: Decanter Pty. Limited, Australia

[21] Appl. No.: 930,774

[22] Filed: Nov. 14, 1986

[30] Foreign Application Priority Data

Nov. 18, 1985 [AU] Australia ..... PH3461

[51] Int. Cl.[4] ..... B04B 3/04

[52] U.S. Cl. ..... 210/374; 494/54; 494/66

[58] Field of Search ..... 494/36, 38, 40, 53, 494/54, 66; 210/360.1, 360.2, 369, 372, 374, 377, 380.1

[56] References Cited

U.S. PATENT DOCUMENTS 2,743,864 5/1956 Lyons ..... 494/54

3,934,792 1/1976 High et al. ..... 494/54

*Primary Examiner*—Frank Sever

*Attorney, Agent, or Firm*—Perman & Green

[57] ABSTRACT

A decanter centrifuge for separation of light and heavy phase material and composed of a rotatable bowl with discharge orifices for the different phases and containing a screw conveyor with a hub supporting helical flights defining a helical chamber divided into a separating zone and a discharging zone by a baffle connected between an adjacent pair of the flights and providing a restricted passageway between the zones, the baffle comprising a flap hinged to the hub so as to be closed under centrifugal force during operation of the centrifuge.

10 Claims, 5 Drawing Figures

DECANTER CENTRIFUGE

This invention relates to Decanter Centrifuge apparatus.

The effectiveness of separation of the different phases of sludge processed by this apparatus depends largely upon the difference in the specific gravity between the phases, but refinement of the apparatus is continually being attempted to improve the purity of the separated phases. One such proposal is described in U.S. Pat. No. 3,934,792 which involves incorporation of a baffle plate fixed between adjacent flights of the screw conveyor to divide the helical chamber formed by the conveyor within the bowl into a separating zone and a discharging zone connected by a restricting passageway defined by the outer edge of the baffle and the inner wall of the bowl. This arrangement has improved the separation between phases, especially in the dewatering or thickening of soft sludges such as waste activated sewage sludge.

However, a problem that arises is that it is desirable to provide only a very small gap between the baffle and the bowl in order to create a small restricted passageway for sludge flow past the baffle, and to have a more stable operation without risk that the centrifuge will "lose seal". Loss of seal results when the greater head of light phase liquid in the separating zone overpowers the head of the heavy sludge phase in the discharging zone, resulting in discharge of very thin cake containing an unacceptable amount of light phase liquid. Waste activated sewage sludge is a biological sludge consisting essentially of micro-organisms and apart from occasional pieces of tramp rubbish is relatively free of solid lumps. Typically, the feed concentration is only 0.5 percent and the cake concentration 5 to 6 percent by weight of solids. This material can be quite effectively thickened in a centrifuge fitted with the above baffle but only when it extends almost to the outer edge of the adjacent conveyor flights, thus leaving a small gap between the baffle and the bowl wall. Under upset condition in the plant, a considerable proportion of coarse fibrous solids may enter the centrifuge with the result of blockage of this gap.

When dewatering coarser sewage sludges such as mixed digested sewage sludge, a much greater gap should be used to prevent the solids blocking in the narrow passageway. A further problem is that such sewage sludge will compact to a dense matt which will not readily deform and thus if the level of cake increases due to either an increase in the solids feed rate or a reduction in the conveyor differential speed between the bowl and the screw conveyor, the height of the cake matt may be greater than the gap in the passageway. The matt then jams against the baffle and transport of the cake ceases. The entire centrifuge must then be disassembled to remove the blockage.

It is the chief object of the invention to provide a centrifuge incorporating an improved form of baffle which at least partly ameliorates this problem.

According to the present invention there is provided a centrifuge for the separation and recovery from an input sludge of at least a light phase and a heavy phase materials, comprising a rotatable elongated bowl, a rotatable coaxial screw conveyor within the bowl and having a hub supporting a plurality of helical flights defining a helical chamber extending between opposite ends of the bowl; discharging means near opposite ends of the bowl for said light and heavy phase materials; and a baffle within said bowl dividing said helical chamber into a separating zone having entry means for said sludge and connecting with said discharging means for the light phase material, and into a discharging zone connecting with said discharging means for the heavy phase material, and having an edge spaced from the bowl inner wall to provide a restricting passageway between said zones; said baffle comprising a frame fixed between an adjacent pair of said helical flights, and a displaceable flap sealably closed against said frame under centrifugal force in operation of the centrifuge and openable under pressure from excessively heavy phase material to permit passage from the separating zone to the discharging zone of abnormal heavy phase material.

By the provision of a displaceable flap for the baffle it will automatically open in response to a high solids loading in the helical chamber of the centrifuge. This allows for provision of a small gap for optimum performance when processing waste activated sludge so that when higher solids loadings are encountered the baffle will open to avoid any blockage of the centrifuge. It has been possible to design the baffle so that the flow of viscous sludge between it and the bowl when processing waste activated sludge does not impose sufficient force on the flap of the baffle to open it against centrifugal force. However, when a layer of strong compacted cake builds up to a sufficient depth to press against the baffle flap it forces the flap to swing open to allow for passage into the discharging zone. The baffle flap will close again under centrifugal force when the high solids loading condition no longer exists. Thus, this permits establishment of the centrifuge under optimum conditions for thickening of waste activated sludge so that without stopping and dismantling the centrifuge for adjustment to the baffle, it can be operated on dewatering of mixed digested sludge without encountering blockage problems. The occasional blockage presently resulting from the passage of tramp coarse particles when processing waste activated sludge is therefore eliminated.

The invention will be described in more detail with reference to the accompanying drawings, in which.

Figure 1:
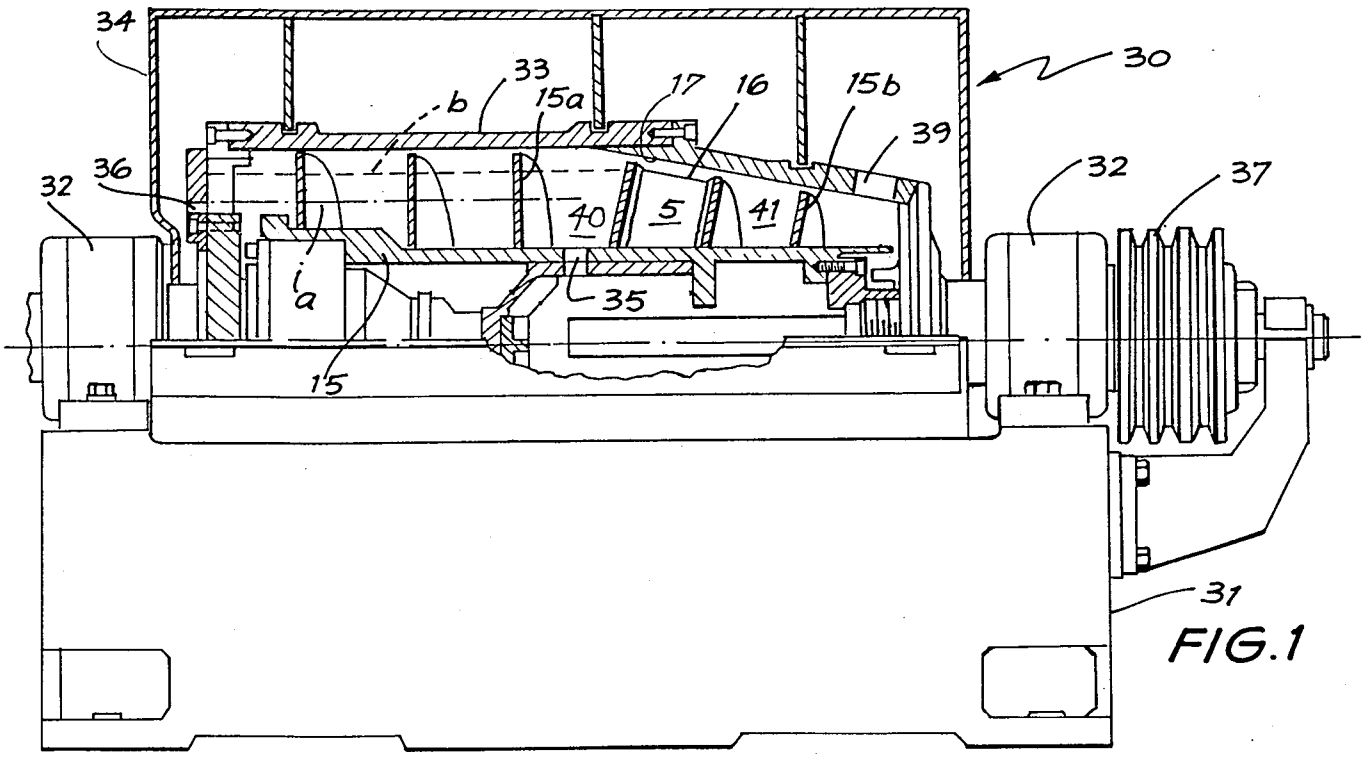
FIG. 1 is a part sectional side elevation of a decanter centrifuge incorporating the present invention.

A decanter centrifuge 30 embodying the concept of this invention is shown in FIG. 1. It includes a base frame 31 rotatably mounting in end bearings 32 a bowl 33 enclosed within a fixed casing 34. Sludge is fed to a separating zone 40 in the interior of the bowl 33 via a series of passageways such as passageway 35. A series of ports 36 serve for the discharge of light phase from the bowl 33 whereby, during its rotation in service by drive applied to pulley 37, the sludge will be caused by centrifugal action to separate into distinct phases, the inner annular surface of the light phase material being shown by the broken line a, and the annular interface between the light and heavy phases being indicated by the broken line b. A series of orifices 39 at the opposite end of the bowl 33 serve for recovery of the heavy phase material.

A flight conveyor 15 positioned within the bowl 33 is rotated by conventional means at a somewhat different speed from the bowl 33 and is provided with upstanding screw flights 15A provided as a cylindrical coil, and upstanding screw flights 15B which are conically coiled. Thus a helical chamber is formed between the opposite ends of the bowl 33. By the present invention a baffle 5 is provided between adjacent ones of the flights 15B to provide a restricted passageway between the outer edge 16 of the baffle 5 and the inner wall 17 of the centrifuge bowl 33 which forms a partition between the separating zone 40 and a discharging zone 41 for heavy phase material.

Figure 2:
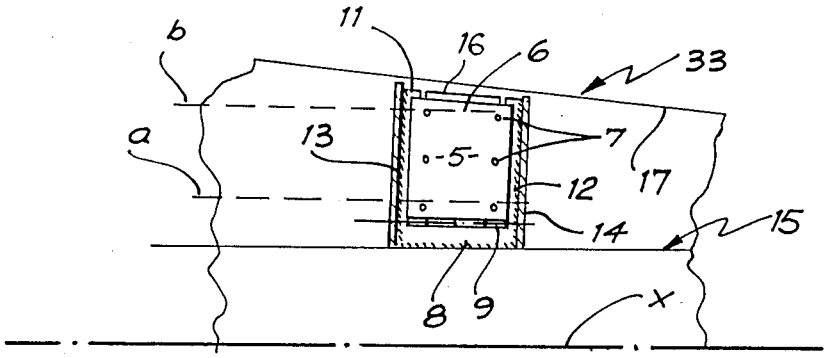
FIG. 2 shows diagramatically, in fragmentary longitudinal section of the centrifuge, a baffle according to a first embodiment of this invention.
Figure 3:
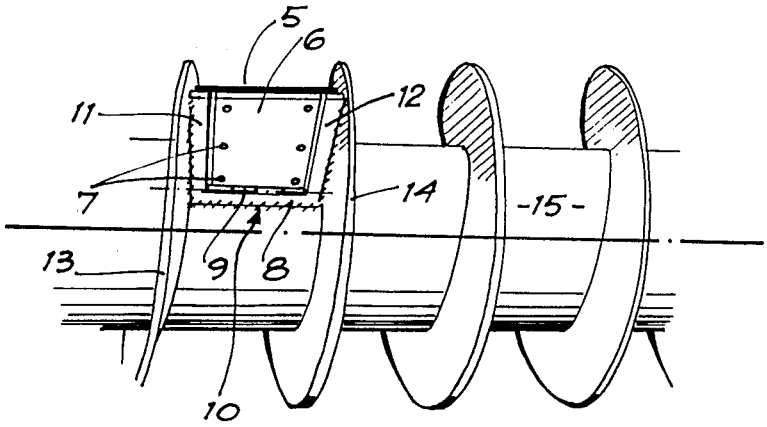
FIG. 3 shows in perspective the baffle of FIG. 2 in position between adjacent flights of the screw conveyor.

With reference to the embodiment shown in FIGS. 2 and 3 it will be seen the baffle 5 consists of a rectangular sheet of rubber, or other resilient material, affixed to a rectangular metal plate 6 of somewhat smaller dimensions by rivets 7. The plate 6 is connected to a base section 8 by a hinge 9. The base section 8 forms part of a U-shaped frame 10 whose parallel arms 11 and 12 provide lateral supports for the resilient sheet baffle 5. The frame 10 is secured by welding between confronting surfaces of adjacent flights 13 and 14 of the flight conveyor 15 with the base 8 welded to the hub 15A of the conveyor 15.

It will be noted, therefore, that the resilient sheet 5 and its attached plate 6 function as a flap 5A and when closed the baffle provides a sealed partition, the resilient baffle sheet 5 being urged under centrifugal force against the face of each of the frame arms, 11 and 12 at the side thereof facing said discharging zone. Preferably, the plane through the broad surfaces of the flap 5A is off-set from radial alignment with the axis of the centrifuge 33, so that the tendency of the flap 5A is to over-close under centrifugal force to effect positive sealing between the sheet 5 and the frame arms 11 and 12. Preferably, the offsetting of the flap 5A from the radial line is approximately 15 degrees to effect adequate sealing of the resilient sheet 6 against the frame arms 11 and 12.

To minimise sealing problems the hinge 9 is located at a smaller radius from the center line x of the centrifuge than the inner level. shown by broken line a, of the light phase material within the bowl, i.e. less radially spaced than the light phase discharge orifices 36. The outer edge 16 of the flap 5A is spaced from the inner wall 17 of the bowl to provide the restricted passageway defined by the outer tips of the two adjacent flights 13 and 14 of the screw conveyor 15, the inner wall 17 of the centrifuge bowl and the outer edge 16 of the baffle. Furthermore, the outer edge 16 of the baffle lies beyond the interface b between the light phase and heavy phase materials occurring during normal operation of the centrifuge.

Through location of the hinge 9 inwardly with respect to the normal inner operating level a of the light phase material it is not necessary that the hinge 9 should be water-tight, it being only necessary that sealing be effected in respect of that portion of the flap 5A which extends radially outwards of the level a. Centrifugal force acting upon the baffle plate 5 can be resolved into two components, one acting in the plane of the baffle plate and another at right angles thereto which serves to close the flap 5A. The weight of the entire flap 5A, i.e. principally that of the metal plate 6, is selected to effect a sufficient closing force at the operating speed of the centrifuge to achieve a water-tight seal and yet not excessive that it cannot be overcome by the force of solids being advanced along the bowl by the flight conveyor 15. It has been found that selection of the weight is not critical in that the necessary sealing force is considerably less than the force generated in the advancing cake. As an alternative to the above-described arrangement the resilient sheet of the baffle 5 may be omitted and the metal plate 6 enlarged to abut frame arms 11 and 12 with the latter provided with resilient sealing material upon their abutting face.

Figure 4:
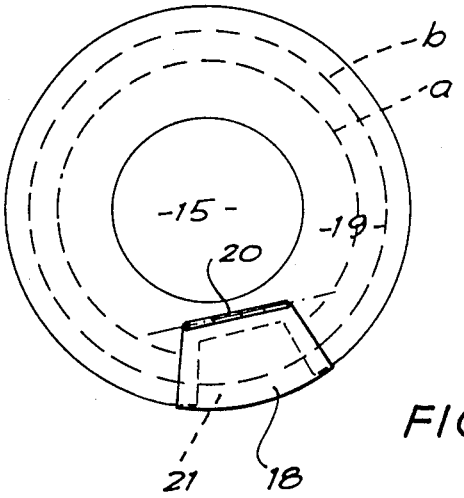
FIG. 4 shows in end elevation a second form of baffle.
Figure 5:
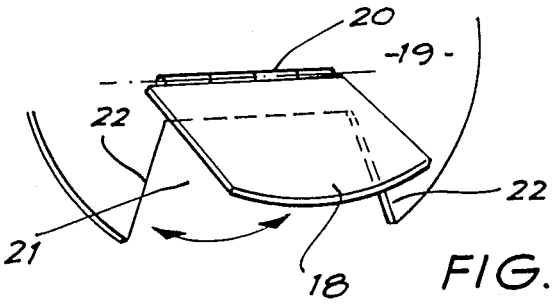
FIG. 5 is a fragmentary view drawn to larger scale of portion of the baffle of FIG. 4.

The principle of the invention may equally be applied to a baffle provided as an annular disc fixed generally in a radial plane from the hub 15A (FIG. 3) to adjacent flights 13 and 14 upon the conveyor 15. FIGS. 4 and 5 show such an arrangement in which a flap 18 is fixed to an annular baffle disc 19 by a hinge 20 in order to cover an aperture 21 in the circumference of the disc 19. The flap 18 is of larger dimensions than the aperture 21 so as to overlie marginal edge portions 22 of the disc 19 surrounding the aperture 21. Suitable resilient sealing strips may be attached to the flap 18 or the portions 22 for effective sealing under centrifugal force during operation of the centrifuge. Alternatively, a sheet of resilient material may be affixed to that face of the flap 18 confronting the disc 19. The hinge 20 is preferably positioned upon the disc 19 at a position radially inward of the inner surface of the light phase material occurring during normal operation of the centrifuge. This level is shown by the broken line a, with the interface between the light phase and heavy phase materials being indicated by the broken line b. To improve the quality of sealing between the flap 18 and disc 19, the disc 19 may be fixed to the conveyor 15 in a plane offset from the radial plane through the conveyor 15, or alternatively, the flap 18 may be of triangular cross section so that its centre of gravity is offset from the face sealing against the disc.

Two principal embodiments have been described in the foregoing passages together with several possible modifications, but it should be understood that other forms are possible within the scope of the invention. For example, instead of the baffle 5 comprising a rigid flap it could be composed of a flexible envelope containing a high density liquid, or even granules. In such a case cake, or lumps of material, being advanced by the conveyor 15 would displace the relevant part of the envelope contacted to allow for passage of the material without influencing sealing by other parts of the envelope. In this way large lumps of coarse cake may pass the baffle to the entire exclusion of light phase material.

What I claim is:

1. A centrifuge for the separation and recovery from an input sludge of at least a light phase and a heavy phase materials, comprising a rotatable elongated bowl, a rotatable coaxial screw conveyor within the bowl and having a hub supporting a plurality of helical flights defining a helical chamber extending between opposite ends of the bowl; discharging means near opposite ends of the bowl for said light and heavy phase material; and a baffle forming a partition within said bowl, said partition dividing said helical chamber into a separating zone having entry means for said sludge and connecting with said discharging means for the light phase material, and into a discharging zone connecting with said discharging means for the heavy phase material, and having an edge spaced from the bowl inner wall to provide a restricting passageway between said zones; and further comprising means for preventing blockage of said restricted passageway by a cake of heavy phase material including means for providing said baffle as a frame fixed between an adjacent pair of said helical flights, and having a displaceable flap sealably closed against said frame under centrifugal force in operation of the centrifuge and opened under pressure from said cake of heavy phase material to permit passage thereof from the separating zone to the discharging zone.

2. A centrifuge according to claim 1, wherein the flap is hinged with respect to the frame remote from said edge of the baffle.

3. A centrifuge according to claim 2, wherein the frame is U-shaped with a base and side plates and spans confronting surfaces of the adjacent helical flights to which the side plates are fixed with the base fixed to the hub of the conveyor.

4. A centrifuge according to claim 2 or 3, wherein the flap is resilient and is secured to a plate of a weight to ensure at the operating rotational speed of the centrifuge a predetermined closing force of the flap onto the frame at the side thereof facing said discharging zone.

5. A centrifuge according to claim 4, wherein the plane of the flap is offset from a radial alignment with the axis of the bowl to produce a tendency of the flap to over-close upon said frame.

6. A centrifuge according to claim 5, wherein said offset is 15° .

7. A centrifuge according to claim 2, wherein hingeing of said flap is at a position less radially spaced from the axis of the bowl than the light phase discharging means, whereby during operation of the centrifuge the light phase material is radially spaced beyond the hinge.

8. A centrifuge according to claim 1 or 2, wherein said frame is an annular disc fixed about the hub and provided with an aperture in its circumference covered by said flap when closed.

9. A centrifuge according to claim 8, wherein the annular disc is disposed in a plane offset from a radial plane about said hub.

10. A centrifuge according to claim 1, wherein the helical flights are disposed in two co-linear groups, a first of said groups defining said separating zone and being provided as a cylindrical coil, and a second of the groups defining said discharging zone and being provided as a conical coil, and wherein said baffle is positioned between adjacent ones of the flights in said second group.

* * * * *